US005866829A

United States Patent [19]

Pecoraro

[11] Patent Number: 5,866,829

[45] Date of Patent: Feb. 2, 1999

[54] PEDAL RACK

[76] Inventor: Thomas Pecoraro, 1057 Westminster Ave., Dix Hills, N.Y. 11746

[21] Appl. No.: 770,341

[22] Filed: Dec. 20, 1996

[51] Int. Cl.[6] ..... G10C 3/02

[52] U.S. Cl. ..... 84/177

[58] Field of Search ..... 84/453, DIG. 17, 84/225, 177

[56] References Cited

U.S. PATENT DOCUMENTS

| | | | |
|---|---|---|---|
| 3,433,881 | 3/1969 | Cotten . | |
| 4,445,415 | 5/1984 | Izquierdo | 84/177 |
| 4,488,468 | 12/1984 | Peterson . | |
| 5,166,467 | 11/1992 | Brown . | |
| 5,442,986 | 8/1995 | Cota | 84/267 |
| 5,452,951 | 9/1995 | Peller | 312/310 |

FOREIGN PATENT DOCUMENTS 0307798 12/1989 Japan .

*Primary Examiner*—William M. Shoop, Jr.
*Assistant Examiner*—Shih-Yung Hsieh
*Attorney, Agent, or Firm*—Michael I. Kroll

[57] ABSTRACT

A pedal rack (10) comprising a case (12) with a plurality of a variety of electronic components (14) that may be electrically connected together and retained within the case (12). A sound control unit (16) may be electrically connected to the electronic components (14). A facility (18) is for pivotally mounting the sound control unit (16) within the case (12). The sound control unit (16) can go between a generally horizontal storage position "A" over the electronic components (14) and into an upright operational position "B" for easy access. The sound control unit (16) may also be completely removed from the case (12).

5 Claims, 6 Drawing Sheets

PEDAL RACK

BACKGROUND OF THE INVENTION

1. Field of the Invention

The instant invention relates generally to electronic musical instrument equipment and more specifically it relates to a pedal rack. The pedal rack combines a musicians favorite foot controlled components and a rack mountable unit into one case.

2. Description of the Prior Art

Numerous electronic musical instrument equipment have been provided in prior art. For example, U.S. Pat. No. 3,433,881 to Cotten; U.S. Pat. No. 4,488,468 to Peterson et al.; U.S. Pat. No. 5,166,467 to Brown and Japanese patent numbered JA1-307798 to Kato all are illustrative of such prior art. While these units may be suitable for the particular purpose to which they address, they would not be as suitable for the purposes of the present invention as heretofore described.

COTTEN, RICHARD M.

PEDAL BOARD FOR MUSICAL INSTRUMENT

U.S. Pat. No. 3,433,881

A pedal board for an electronic musical instrument comprising a first longitudinal row of spaced pedals, a second longitudinal row of spaced pedals laterally adjacent the first row, so that each pedal in the first row is transversely aligned with a pedal in the second row. An electronic sound producing means is provided. An electrical switch means connects each pedal to the sound producing means, so that the switch means are normally opened in an operative position and closed in an operative position by the depression of the pedals, to produce a tone in the sound producing means. The tones produced by the successive pedals in the first row correspond to the notes in the chromatic scale. The tones produced by the successive pedals in the second row correspond to the notes in the chromatic scale. The tone produced by each pedal in the second row is a perfect fourth musical internal above the tone produced by the transversely aligned pedal in the first row.

PETERSON, RICHARD H.

BOVENIZER, PATRICK J.

JENSEN, RICHARD W.

HAAS, WILLIAM H.

ELECTRONIC MUSICAL INSTRUMENT AND COMPACT PEDAL BOARD AND STORAGE CASE THEREFOR

U.S. Pat. No. 4,488,468

An electronic musical instrument including a compact, portable pedal board and a storage case for the pedal board and for the electronic components of the instrument is disclosed. The pedal board includes shortened foot pedals, having a low profile and a very low throw for activating control switches for the electronics, whereby the pedal board can be used in conjunction with a piano or with other instruments. The low throw is obtained through the use of a guide channel mounting arrangement for the pedals and by the use of pressure sensitive switching. The storage case receives and secures the pedal board and also provides a housing for the tone generator, amplifier and other electronics controlled by the pedal board. A control panel door on the end of the storage case is adapted to receive a control panel, and is hinged to the storage case, so that it may be swung fully open to expose the control panel. The case may then be positioned on its opposite end to serve as a display stand for the control unit. The control panel door may be completely separable from the case, so that the control panel may be mounted at a remote location.

BROWN, TOMMY M.

FOOT PEDAL OPERATION OF AN ELECTRONIC SYNTHESIZER

U.S. Pat. No. 5,166,467

A chord-generating synthesizer system including an electronic keyboard instrument and a remote control unit operable by a musician's foot, while the musician is using both hands to simultaneously play an instrument such as a guitar. The keyboard instrument is formed with circuit electronics for generating polyphonic music, and has internal wiring that provides a plurality of normally open circuit loops. Each circuit loop includes a pair of connector output terminals for closure of the loop. The circuit electronics is responsive to closure of the loops for generating a note or chord. The remote control unit is separate and external from the instrument, but is selectively connected to the instrument by a multi-lead cable; the unit includes multiple connector inputs and a plurality of switches. Each switch is wired between at least a pair of the connector inputs for remote control of the chord-generating function of the keyboard instrument. Six rocker-type foot pedals are preferred, each of which is connected to two switches, so that twelve chords may be easily generated with one of the musician's feet. Operation of controls on the remote unit with a musician's foot enables the musician to play a chord accompaniment, while the musician simultaneously plays notes on a lead instrument with one or both hands. Hence, a musician or composer can have the benefit of accompaniment without the burden of identifying and gathering others who are willing and able to help with suitable accompaniment.

KATO, KAZUJI

AUXILIARY DEVICE STORAGE CASE FOR PLAYING INSTRUMENT

Japanese Patent Number JA1-307798

A auxiliary device storage case for a playing instrument is provided. It enables play that a player intends by composing the storage case of a lid body which is detachable or freely opened and closed and an auxiliary device storage part, and dividing the auxiliary device storage part into two or dividing it into two and supporting them pivotally at one end. When an effect sound generation unit groups is stored in the auxiliary device storage part, the effect sound generation unit group is stored in an opposite state about the division expansion part of the divided storage parts and which are engaged with each other. When this case is used for play, engaged metallic fixtures of an upright flank are disengaged from each other and mounted in an expanded state. Consequently, the player switches the effect sound of the effect sound generation unit group without floating his or her heel from a floor surface. Consequently, when the play is carried out for a long time, the musical play that the player himself or herself intends can be performed without being affected by the fatigue of the player.

SUMMARY OF THE INVENTION

A primary object of the present invention is to provide a pedal rack that will overcome the shortcomings of the prior art devices.

Another object is to provide a pedal rack that will combine foot controlled electronic components and a rack mounted sound control unit, so that they may be electrically connected together into one convenient carry case.

An additional object is to provide a pedal rack in which the rack mounted sound control unit can be pivoted into an upright position for easy access and can fold down quickly into a storage position within the case, thereby saving lots of time when setting up, or may be completely removed from the case.

A further object is to provide a pedal rack that is simple and easy to use.

A still further object is to provide a pedal rack that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
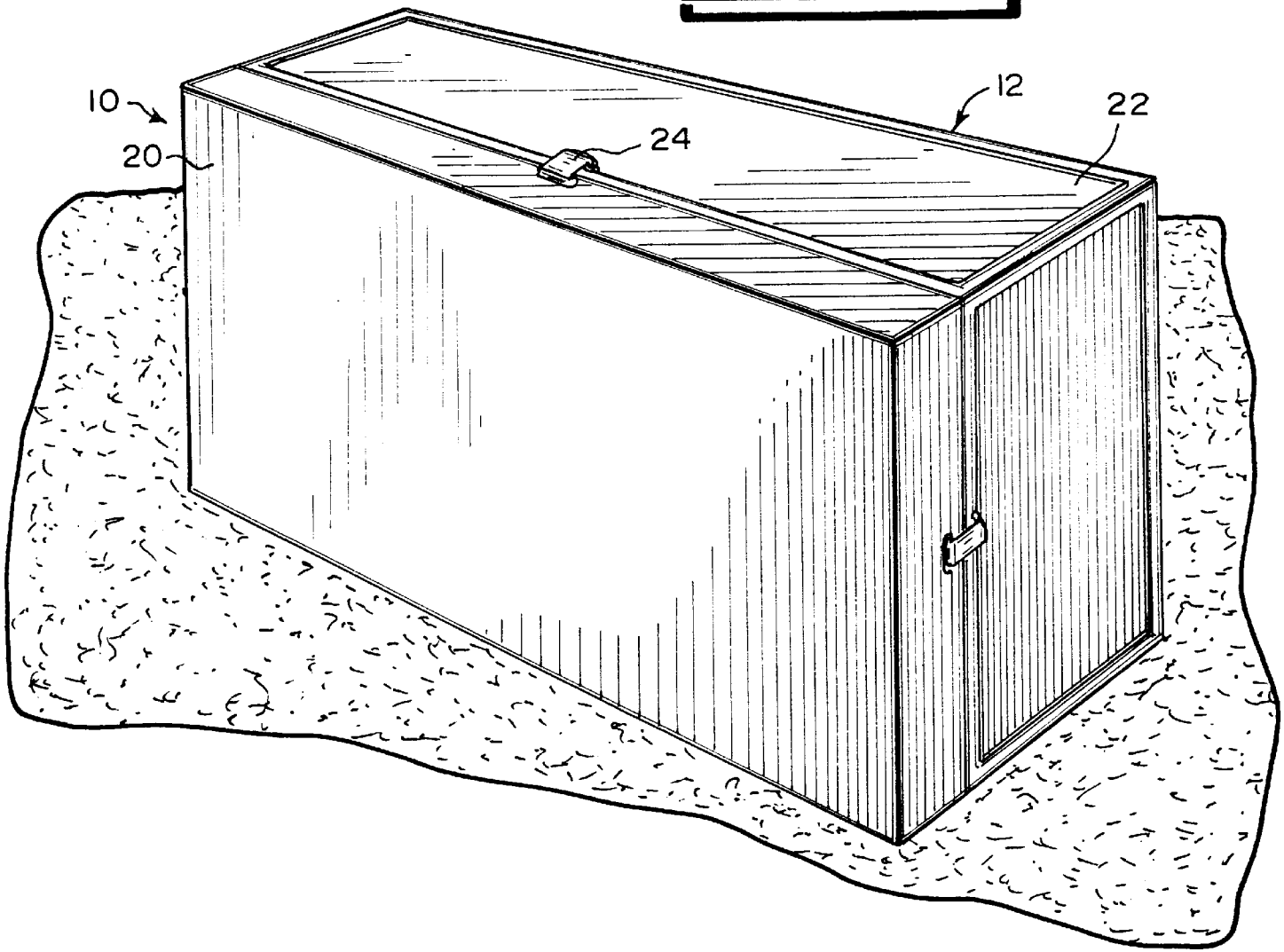
FIG. 1 is a perspective view of a first embodiment of the instant invention in a closed storage position upon a floor.

Turning now descriptively to the drawings, in which similar reference characters denote similar elements throughout the several views, FIGS. 1 to 8 illustrate a pedal rack 10 comprising a case 12 with a plurality of a variety of electronic components 14 that may be electrically connected together and retained within the case 12. A sound control unit 16 may be electrically connected to the electronic components 14. A facility 18 is for pivotally mounting the sound control unit 16 within the case 12. The sound control unit 16 can go between a generally horizontal storage position "A" over the electronic components 14 and into an upright operational position "B" for easy access. The sound control unit 16 may also be completely removed from the case 12.

The case 12 consists of a base 20 for receiving the electronic components 14 and the pivotally mounting facility 18 with the sound control unit 16. A cover 22 fits over the base 20, when the sound control unit 16 on the pivotally mounting facility 18 is placed into the generally horizontal storage position "A" over electronic components 14. A plurality of latch mechanisms 24 hold the cover 22 onto the base 20, so that the case 12 holding the electronic components 14 and the pivotally mounting facility 18 with the sound control unit 16 can be safety transported.

Some of the electronic components 14 are module sound processors 26. At least one of the electronic components 14 is a foot rocker control pedal 28. The sound control unit 16 includes a box shaped housing 30, having a front face panel 32. A plurality of manually operated hand controls 34 are on the front face panel 32.

The pivotally mounting facility 18 is a rack 36 affixed to the sound control unit 16 and hinged within the base 20 of the case 12. The rack 36 comprises a pair of support members 38 spaced apart and affixed into the case 12. A pair of elongate arms 40 are provided.

An assemblage 42 is for connecting a lower end of each elongate arm 40 to a top end of each support member 38, so that the elongate arms 40 can pivot upon the support members 38. A structure 44 is for attaching an upper end of each elongate arm 40 to a front corner of the sound control unit 16.

The attaching structure 44 includes a pair of mounting brackets 46. Each mounting bracket 46 is attached at a slight forward angle between the upper end of one elongate arm 40 and the front corner of the sound control unit 16.

Figure 2:
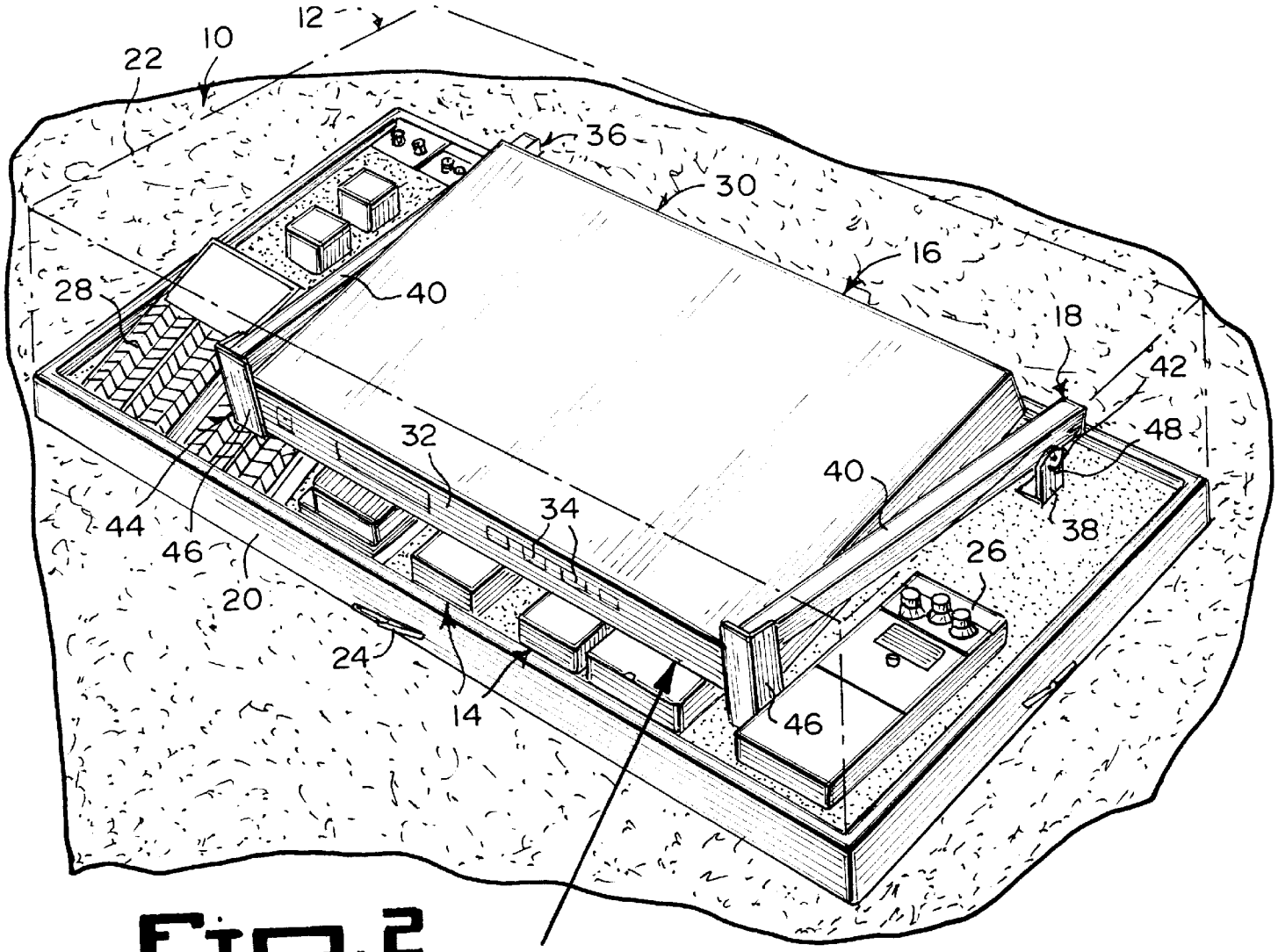
FIG. 2 is a perspective view of the first embodiment, in which the base is flat upon the floor, the cover shown in phantom and the rack mounted sound control unit folded down upon the foot controlled electronic components within the base.
Figure 3:
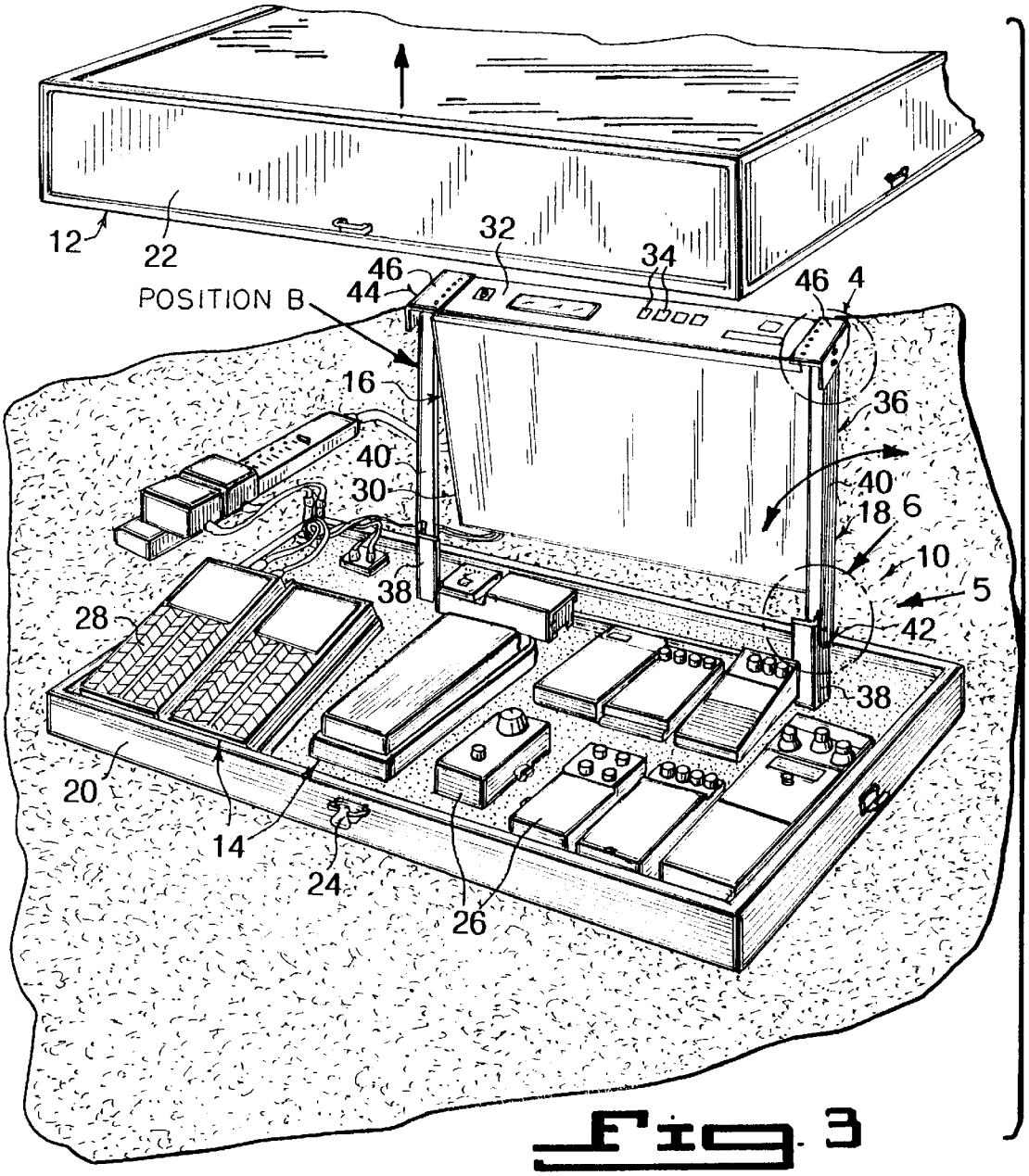
FIG. 3 is a perspective view of a second embodiment of the instant invention, showing the cover lifted up and the rack mounted sound control unit in an upright position.

The pivot connecting assemblage 42 is a pair of pivot pins 48, one of which is best seen in FIG. 2. Each pivot pin 48 extends through a lower end of one elongate arm 40 and a top end of one support member 38.

Figures 4, 5, 6:
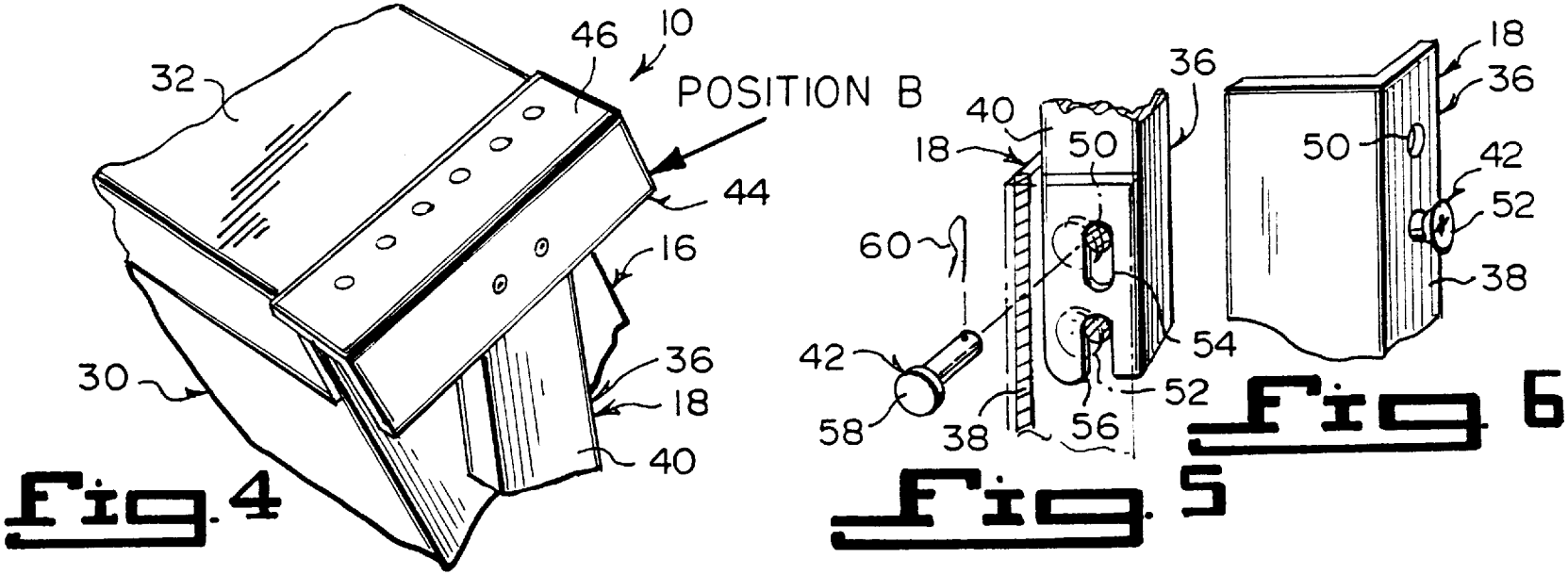
FIG. 4 is an enlarged perspective view of the area in FIG. 3 indicated by arrow 4.
FIG. 5 is a partly exploded perspective view taken in the direction of arrow 5 in FIG. 3, with parts shown in cross section and in phantom.
FIG. 6 is an enlarged perspective view of the area in FIG. 3 indicated by arrow 6.
Figure 7:
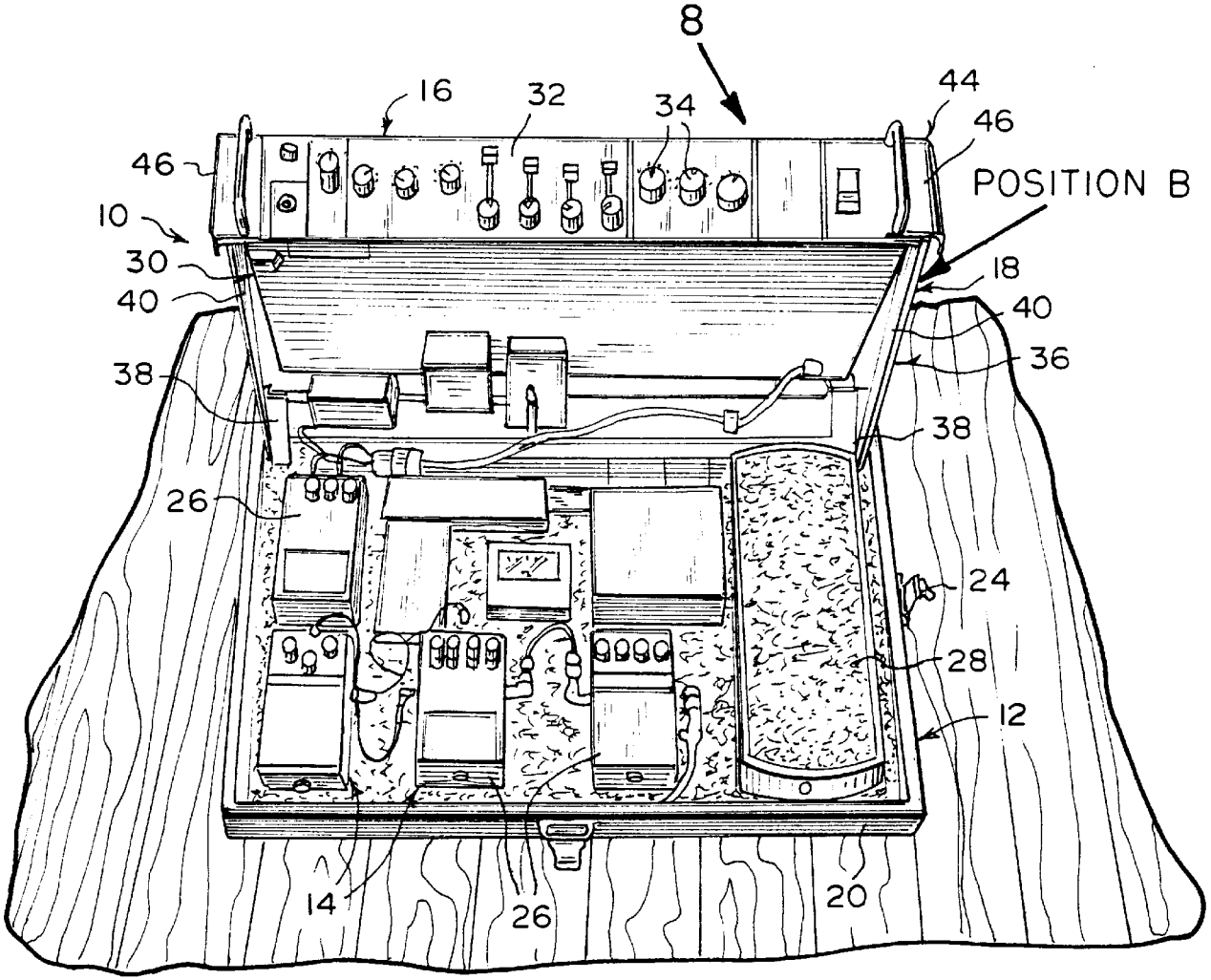
FIG. 7 is a top perspective view of a third embodiment of the instant invention, showing the cover removed and the rack mounted sound control unit in an upright position.
Figure 8:
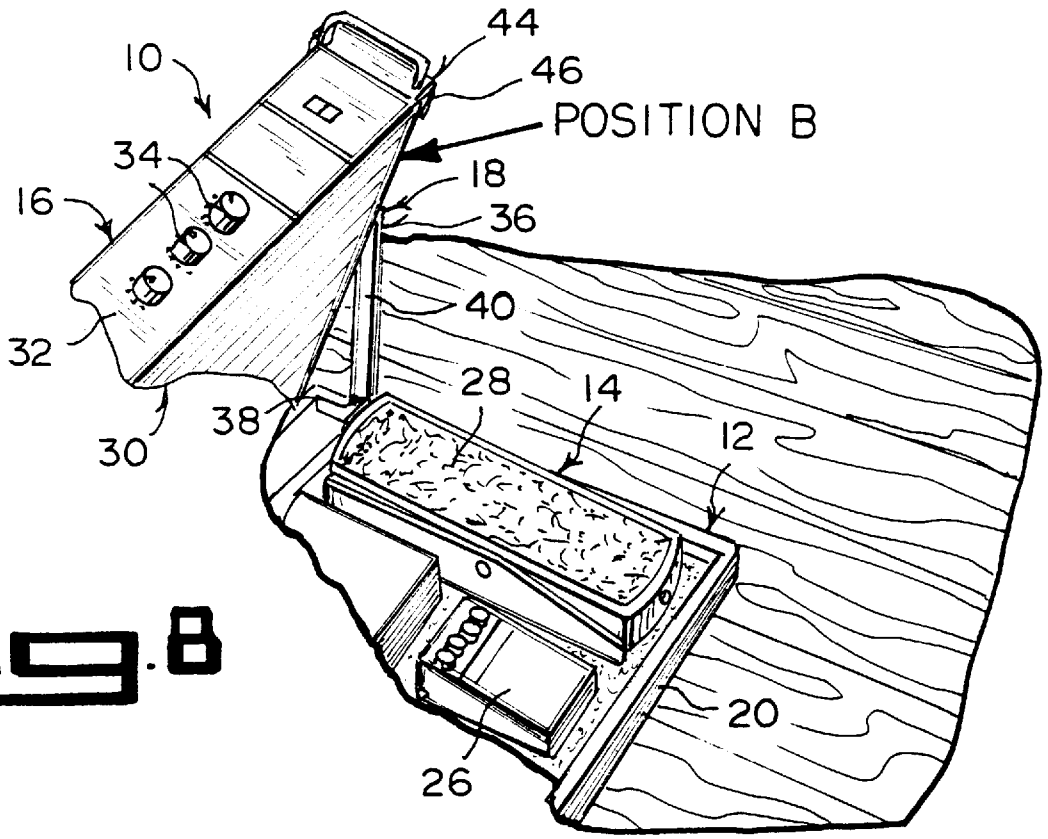
FIG. 8 is a top perspective view taken in the direction of arrow 8 in FIG. 7, with parts broken away.

The pivot connecting assemblage 42, as best shown in FIGS. 5 and 6, consists of each support member 38 having an aperture 50 therethrough. A pair of locking studs 52 are provided. Each locking stud 52 is mounted onto one support member 38 below the aperture 50. The elongate arms 40 each have a slotted hole 54 near the lower end and a slot 56 extending upwardly from the lower end below the slotted hole 54. The slots 56 can fit onto the locking studs 52 to lock the elongate arms 40 into the upright operational position "B".

The pivot connecting assemblage 42 further includes a pair of quick release pivot pins 58. Each pivot pin 58, as shown in FIG. 5, is insertable through one slotted hole 54 in one elongate arm 40 and one aperture 50 in one support member 38. A pair of safety clips 60 are provided. Each safety clip 60 is insertable through one pivot pin 58, after the pivot pin 58 is placed through one slotted hole 54 in one elongate arm 40 and one aperture 50 in one support member 38 to keep the pivot pin 58 in position. The rack 36 can pivot into the generally horizontal storage position "A", when the elongate arms 40 are lifted upwardly and the slots 56 are released from the locking studs 52.

LIST OF REFERENCE NUMBERS

A horizontal storage position
B upright operational position
10 pedal rack
12 case of 10
14 electronic component of 10
16 sound control unit of 10
18 pivotally mounting facility of 10
20 base of 12
22 cover of 12
24 latch mechanism of 12
26 module sound processor for 14
28 foot rocker control pedal for 14
30 box shaped housing of 16
32 front panel on 30
34 manually operated hand controls of 16 on 32
36 rack for 18
38 support member of 36
40 elongate arm of 36
42 pivot connecting assemblage of 36
44 attaching structure of 36
46 mounting bracket of 44
48 pivot pin of 42
50 aperture in 38
52 locking stud of 42 on 38
54 slotted hole in 40
56 slot in 40
58 pivot pin of 42
60 safety clip on 42

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the devices illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pedal rack comprising:

a) a case comprising a base and a removable cover connected by latch mechanisms when said case is closed;

b) a plurality of electronic components electrically connected together and retained within said case on said base;

c) a sound control unit electrically connected to said electronic components comprising a box shaped housing having a front face panel and exclusively a plurality of hand controls on said front face panel;

d) means comprising a rack affixed to said sound control unit hinged within said base of said case for pivotally mounting said sound control unit within said case, said sound control unit being movable between a generally horizontally storage position over said electronic components and an upright operational position perpendicular to said base with said front face panel facing upwardly for easy access, said sound control unit being readily removable from said case; and e) said rack comprising a pair of spaced stationary support members at right angles to and affixed to said base, a pair of elongate arms, means for connecting a lower end of each said elongate arm to a top end of each said support member permitting said elongate arms to pivot about said support members, and means for attaching an upper end of each said elongate arm to a front corner of said sound control unit.

2. A pedal rack as recited in claim 1, wherein said electronic components include module sound processors.

3. A pedal rack as recited in claim 1, wherein at least one of said electronic components is a foot rocker control pedal.

4. A pedal rack as recited in claim 1, wherein said attaching means includes a pair of mounting brackets, each said mounting bracket attached at a slight forward angle between the upper end of one said elongate arm and the front corner of said sound control unit.

5. A pedal rack as recited in claim 1, wherein said pivot connecting means includes a pair of pivot pins, wherein each said pivot pin extends through a lower end of one said elongate arm and a top end of one said support member.

* * * * *